US005605236A

United States Patent [19]

Welch

[11] Patent Number: 5,605,236

[45] Date of Patent: Feb. 25, 1997

[54] DISHWASHER RACK

[75] Inventor: Rodney M. Welch, Newton, Iowa

[73] Assignee: Maytag Corporation, Newton, Iowa

[21] Appl. No.: 405,731

[22] Filed: Mar. 17, 1995

[51] Int. Cl.[6] ..... A47F 7/00

[52] U.S. Cl. ..... 211/41

[58] Field of Search ..... 211/41, 71; 220/97, 220/23.4; 312/311

[56] References Cited

U.S. PATENT DOCUMENTS

| | | | |
|---|---|---|---|
| D. 188,291 | 6/1960 | Weiss | D49/1 |
| D. 193,108 | 6/1962 | Ettlinger, Jr. | D49/1 |
| 3,141,552 | 7/1964 | Ettlinger, Jr. | 211/41 |
| 3,217,890 | 11/1965 | Maslow | 211/41 |
| 3,245,548 | 4/1966 | Kesilman et al. | 211/71 |
| 3,252,582 | 5/1966 | Kesilman et al. | 211/71 |
| 3,266,632 | 8/1966 | Maslow | 211/41 |
| 3,306,463 | 2/1967 | Maslow | 211/71 |
| 3,392,875 | 7/1968 | Bockenstette | 220/97 |
| 3,433,363 | 3/1969 | Clearman et al. | 211/41 |
| 3,442,397 | 5/1969 | Jaffee et al. | 211/71 |
| 3,809,279 | 5/1974 | Arjas | 220/21 |
| 5,086,544 | 2/1992 | Huttemann et al. | 211/41 |
| 5,351,837 | 10/1994 | Smith | 211/41 |
| 5,431,294 | 7/1995 | Stottmann et al. | 211/41 X |

*Primary Examiner*—Ramon O. Ramirez
*Assistant Examiner*—Sarah L. Purol
*Attorney, Agent, or Firm*—Zarley, McKee, Thomte, Voorhees & Sease

[57] ABSTRACT

A molded plastic dishwasher rack support structure includes a rack base portion with plastic walls extending around the perimeter edge. The rack base portion and walls are formed by a molding process, and include a plurality of cross channels extending between the opposite sides of the rack base portion and opposite side channels extending forwardly and rearwardly adjacent the sides of the rack base portion. Metal structural braces are inserted into the channels of the rack base portion. The rack is rollably supported in the tub of the dishwasher by a plurality of wheels each having a shaft extending through the adjacent side brace. The metal braces and wheels transfer the load of the objects in the rack to the tub of the dishwasher, thereby providing structural integrity for the rack. The braces are slidably movable with respect to one another to accommodate variances in the molding process. In alternate embodiments, the channels may be sealingly closed with a closure flap.

26 Claims, 6 Drawing Sheets

60
64
62
58
56

36B
40B
38B
34
48
42
42
32

54

50
52
32

36C
38C
40C
32

DISHWASHER RACK

BACKGROUND OF THE INVENTION

Dishwasher racks are conventionally constructed from wire and then coated with plastic or vinyl. The plastic or vinyl coating layer is thin, typically 8/1000–15/1000 inch thick. The coating process will sometimes leave pin holes in the plastic or vinyl, which if not sealed, will permit rusting of the inner wire structure. Also, if the coating becomes worn or damaged, the wire will rust.

An all-plastic rack would eliminate the rusting problems of the plastic or vinyl coated wire rack. While plastic can be formed into complex integrated shapes in a single manufacturing operation, as compared to the multi-step assembly and coating of conventional racks, plastic generally lacks the strength to withstand the weight of dishes, glasses, and other objects loaded into the rack for washing. The use of plastic alone would require too much material which would prevent sufficient access to the dishware from the water jets of the dishwasher. If a stronger material is used, such as glass-filled plastic, the rack becomes more expensive to manufacture and more vulnerable to breakage. Most plastic materials also lack heat resistance needed to withstand the high water temperatures of the washing operation. Thus, an all-plastic rack could deform from the combination of dishware load and high water temperature under normal use.

Therefore, a primary objective of the present invention is the provision of an improved support structure for a molded plastic dishwasher rack which is strong, resistant to heat deformation, and allows proper washing of objects held in the rack.

Another objective of the present invention is the provision of an improved dishwasher rack constructed from low-cost plastic with structural reinforcing elements.

A further objective of the present invention is the provision of a molded plastic dishwasher rack having channels into which metal braces are inserted.

Still another objective of the present invention is the provision of support structure for a plastic dishwasher rack having an underlying metal grid for structural stability.

Yet another objective of the present invention is the provision of a dishwasher rack constructed of molded plastic and having a metal lattice work which accommodates variances and tolerances in the molding process.

A further objective of the present invention is the provision of a plastic dishwasher rack having metal cross braces and side braces which provide strength to the rack.

Still another objective of the present invention is the provision of support structure for a dishwasher rack which transfers the load of contained objects to the tub of a dishwasher.

Another objective of the present invention is the provision of a molded dishwasher rack having channels for receiving metal reinforcing braces, wherein the channels can be closed or sealed to prevent moisture from accessing the metal braces.

These and other objectives will become apparent from the following description of the drawings.

SUMMARY OF THE INVENTION

The dishwasher rack of the present invention includes a plastic base portion with opposite side edges and opposite front and back edges. The rack includes upstanding side walls and front and back walls extending upwardly around the perimeter edge of the base portion so as to contain objects to be washed. A plurality of wheels extend from the base portion and engage the tub of the dishwasher so that the rack is rollable out of the tub for easy access to load objects into the rack.

The rack is constructed of molded plastic, with a base portion having a plurality of channels formed in the lower surface thereof. In one embodiment of the invention, cross channels extend between the opposite side edges of the base portion, while side channels extend toward the front and back edges adjacent the side edges of the base portion. A plurality of cross braces are inserted into the cross channels, and side braces are inserted into the side channels. The wheels of the rack have axial shafts which extend through the side braces. The cross braces and side braces may be connected with a joiner or connector which allows sliding movement of the braces relative to one another, thereby accommodating tolerances in the molding process. The combination of braces and wheels transfer the load from the objects to be washed to the tub of the dishwasher. The channels may include a hinged flap or tab for covering and closing the channel after the braces have been inserted, thereby sealing out moisture.

In the method of the present invention, the plastic rack is molded with a plurality of cross channels and side channels in the lower surface of the base portion. The cross braces and side braces are assembled into a grid or lattice work. The grid or lattice work is then inserted into the channels to provide structural support to the plastic rack. In an alternative embodiment the braces are separately inserted into the channels, with a support tab retaining the cross braces in the cross channels.

DETAILED DESCRIPTION OF THE DRAWINGS

Figure 1:
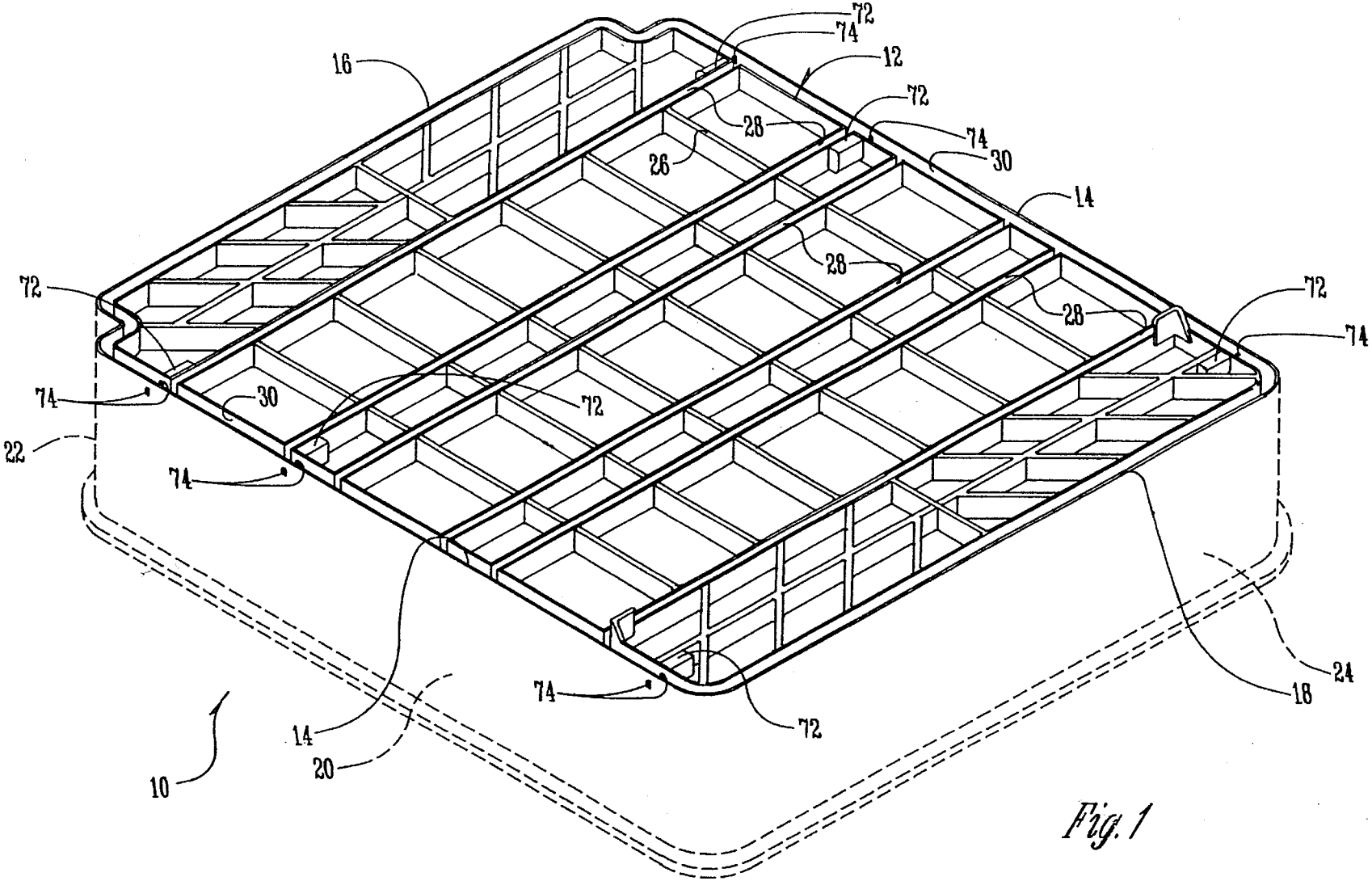
FIG. 1 is a perspective view of a dishwasher rack of the present invention, with the rack turned upside down so as to show the bottom surface of the base portion of the rack.

With reference to the drawings, the reference numeral 10 generally designates the molded dishwasher rack of the present invention without any metal reinforcing members. The rack 10 includes a base portion 12 having opposite side edges 14, a front edge 16, and a rear edge 18. The rack 10 also has upstanding walls extending around the perimeter of the base portion 12, including opposite side walls 20, a front wall 22, and a rear wall 24. The base portion 12 and walls 20, 22, and 24 are constructed of molded plastic, and are shown in shadow lines because their shape and configuration may be varied without detracting from the invention.

As seen in FIG. 1, the rack 10 is inverted so that the lower surface 26 of the base portion 12 is shown. Molded into the lower surface 26 of the base portion 12 are a plurality of cross channels 28 which extend between the opposite side edges 14 and which have a generally U-shaped cross sectional configuration. Opposite side channels 30 are also molded into the lower surface 26 of the base portion 12 adjacent the side edges 14 and extend forwardly and rearwardly. Side channels 30 are also U-shaped in cross section. It is anticipated that alternatively this arrangement could be reversed so that the cross channels 28 extend from the front to the rear of the rack 10.

Figure 2:
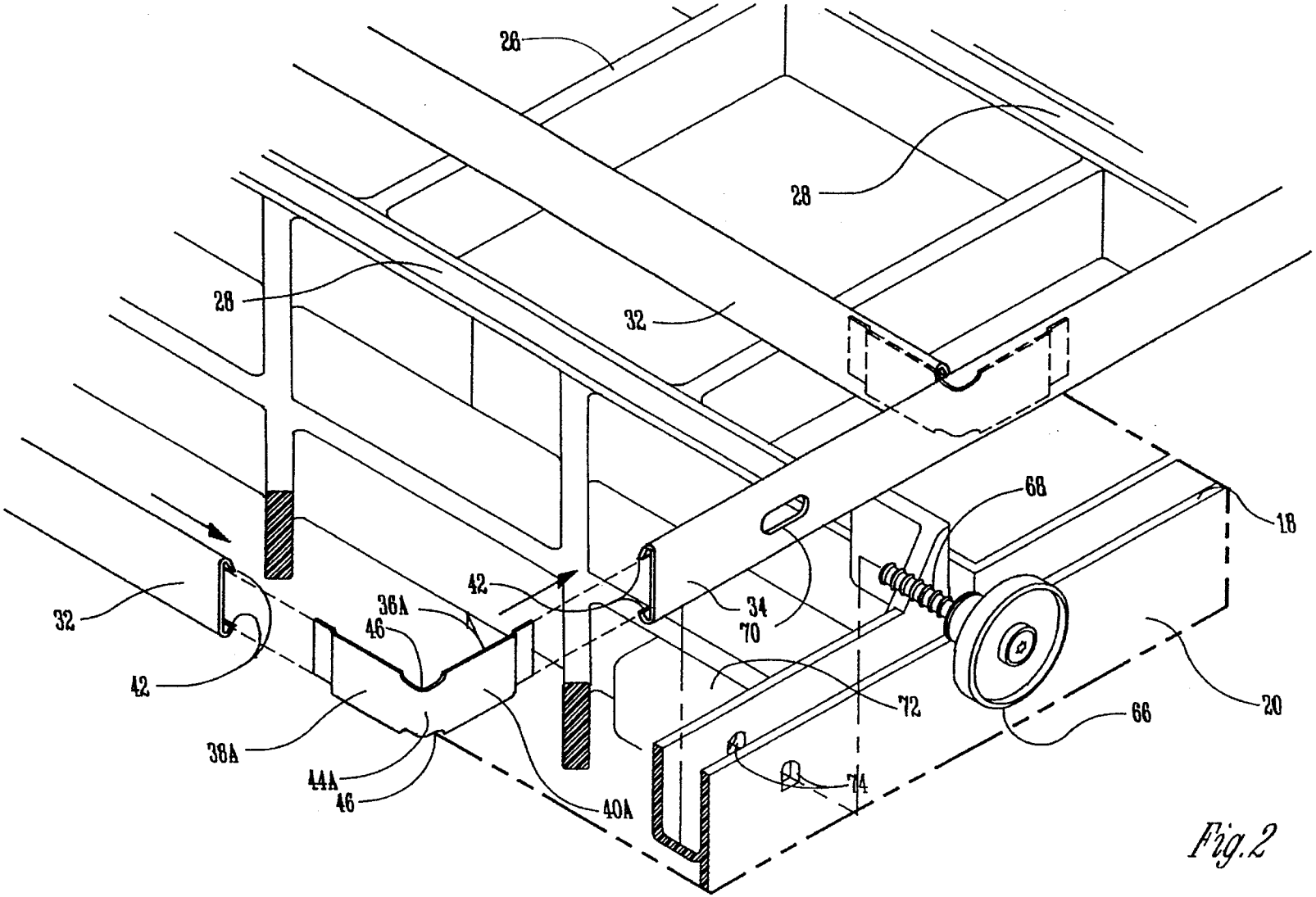
FIG. 2 is a partial exploded perspective view of the metal grid structure and showing a first embodiment of the connection between the cross braces and one of the side braces.

In one embodiment, the rack 10 includes a grid or lattice work of metal braces, as partially shown in FIG. 2. The grid includes cross braces 32 which are adapted to be inserted into the U-shaped cross channels 28, and side braces 34 which are adapted to be inserted into the U-shaped side channels 30 for reinforcing them. In the embodiments shown in FIGS. 2–8, the cross braces 32 and side braces 34 are slidably interconnected, as described in further detail below, so as to accommodate tolerances in the molding process. In the embodiment shown in FIG. 12, the cross braces 90 are not connected to the side braces 93. In the embodiment shown in FIGS. 13 and 14, the cross braces 94 slidingly overlap the side braces 96, thereby accommodating molding variances, but the braces are not fastened together.

In the embodiments shown in FIGS. 2–8, the cross braces 32 and side braces 34 have a C-shaped construction so as to define a groove therein. The braces are interconnected using various joiners or connectors 36A–36C. The connection at each end of each cross brace is identical.

More particularly, as seen in the first embodiment shown in FIG. 2, the connector 36A is L-shaped with first and second legs 38A, 40A. The leg 38A is adapted to be received within the groove of the C-shaped cross brace 32, and the leg 40A is adapted to be received within the groove of the C-shaped side brace 34. The height of the legs 38A and 40A is greater than the space between the terminal ends 42 on the braces 32, 34 such that the legs 38A and 40A are retained within the respective braces. The elbow 44A of the connector 36A includes upper and lower notches 46 which allows the connector to slide along the side brace 34 past terminal ends 42 to a desired position. The connector 36A further allows forward and rearward movement of the cross brace 32 relative to the side brace 34, and allows lateral movement of the side brace 34 relative to the cross brace 32, thereby accommodating tolerances in the molding process.

Figures 4, 5, 6, 7, 8:
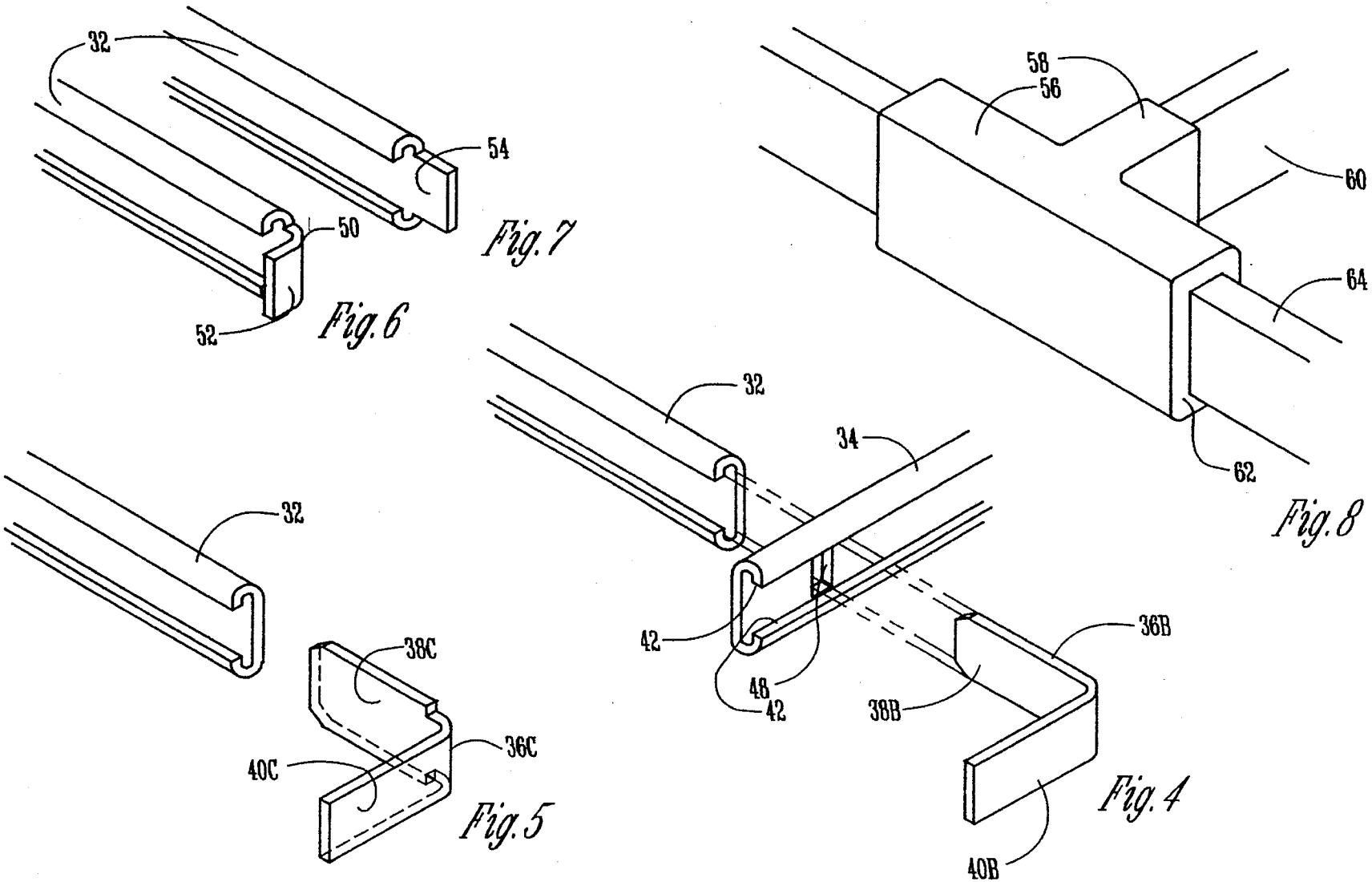
FIG. 4 is a partial perspective view showing a second embodiment of the connection between a cross brace and a side brace.
FIG. 5 is a partial perspective view showing a third embodiment of the connection between a cross brace with a side brace.
FIG. 6 is a partial perspective view showing a fourth embodiment of a cross brace with a connecting tab.
FIG. 7 is a partial perspective view showing a fifth embodiment of a cross brace with a connector tab.
FIG. 8 is a partial perspective view showing a sixth embodiment of a connection between a cross brace and a side brace.

A second embodiment of an L-shaped connector 36B is shown in FIG. 4. The connector 36B includes substantially perpendicular legs 38B and 40B. In this embodiment, the side brace 34 is oriented such that the opening between the ends 42 of the C-shaped brace faces outwardly. The leg 38B of the connector 36B extends through a slot 48 in the side brace 34 and into the cross brace 32. The width of the slot 48 is greater than the thickness of the leg 38B, thereby allowing the cross brace 32 to move forwardly and rearwardly relative to the side brace 34. Similarly, the length of the leg 38B allows the side brace 34 to be spaced closer to or further from the cross brace 32. Thus, the connector 38B accommodates tolerances in the molding process.

A third embodiment of a connector 36C is shown in FIG. 5. In the connector 36C, the first leg 38C has a height greater than that of the second leg 40C, such that the leg 38C will be retained within the cross brace 32, similar to the leg 38A of the connector 36A described above. To assemble the cross brace 32 and side brace 34 using the connector 36C, the first leg 38C is inserted into the cross brace 32. The cross brace 32 is positioned substantially parallel to the side brace 34 so that the second leg 40C can be inserted through the slot 48, and the braces are then pivoted substantially 90° so that the second leg 40C is retained in the side brace 34. Alternatively, the slot 48 can be increased in height and intersecting a portion of the terminal ends 42 of the C-shaped side brace 34, such that the first leg 38C of the connector 36C can extend through the slot 48 for receipt in the cross brace 32.

FIG. 6 shows a further embodiment wherein the connector comprises a tab 50 on each end of the cross brace 32. The tab 50 extends outwardly from the end of the cross brace 32 and has a primary leg 52 extending substantially perpendicularly to the longitudinal axis of the cross brace 32. The tab 50 is adapted to be received in the slot 48 of the side brace 34 by positioning the cross brace 32 substantially parallel to the side brace 34 and then pivoting the cross brace 32 substantially 90° such that the primary leg 52 of the tab 50 engages the side brace 34. The relative movement between the braces 32, 34 is less with tab 50 than in other embodiments.

FIG. 7 shows still another embodiment wherein a tab 54 extends axially from the end of the cross brace 32 for receipt in the slot 48 of the side brace 34. Since the slot 48 is wider than the thickness of the tab 54, the braces 32, 34 are slidable forwardly and rearwardly with respect to one another. Also, the length of the tab 54 allows relative lateral movement between the braces 32, 34.

In each of the embodiments shown in FIGS. 2–7, there is sufficient play in the connectors 36 or the tabs 50 and 54 so as to accommodate tolerances in the molding process.

FIG. 8 shows a different embodiment wherein the connector comprises a T-shaped collar 56 having a hollow leg 58 for receiving one end of a cross brace 60 and a hollow head 62 for slidably receiving the side brace 64. The leg 58 and head 62 allow the cross brace 60 and side brace 64 to slide or move with respect to one another, thereby accommodating variances in the molding process. While the cross brace 60 and side brace 64 are shown to be rectangular in FIG. 8, the braces can also be square or round, with the T-shaped collar 56 having a corresponding mating shape for the leg 58 and the head 62.

The rack 10 is rollably supported within the tub of the dishwasher by a plurality of wheels 66. Each of the wheels 66 is rotatably mounted upon a threaded shaft 68 which extends through an elongated slot 70 in the side brace 34. The slot 70 further accommodates variances in the molding process. The shaft 68 is threadably received within a boss 72 on the base portion 12. The side edges 14 of the base portion 12 have corresponding holes 74 through which the shaft 68 extends, as seen in FIG. 1.

Figure 15:
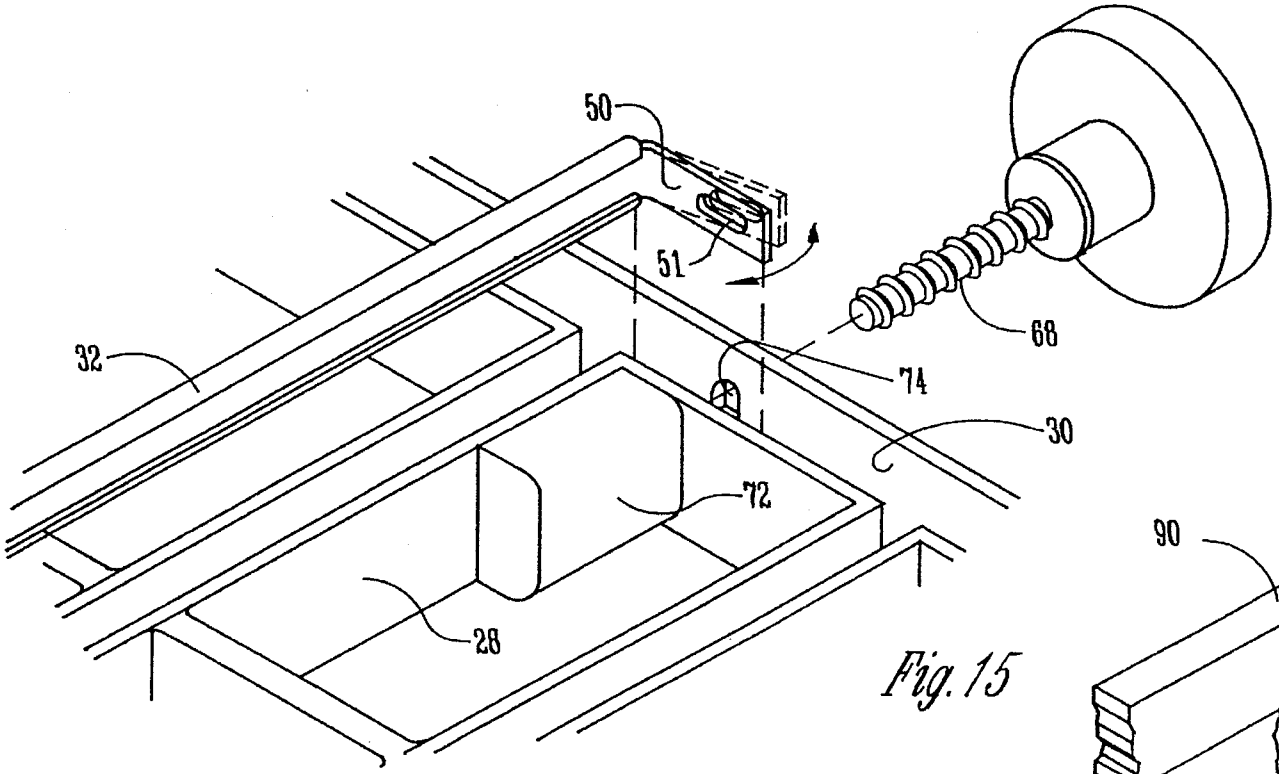
FIG. 15 is a pictorial view of a modified form of the present invention.

The instant invention which provides support structure for a plastic dishrack may also be practiced by providing a plurality of cross channels 28 and with one of the cross channels 28 adjacent to each of the bosses 72 (FIG. 15). The cross braces 32 inserted into these cross channels 28 would be similar in shape to the cross brace 32 shown in FIG. 6 except that the tab 50 would be elongated and would have an aperture 51 for receiving the threaded shaft 68. The tab 50 could be bent to accommodate side-to-side variation and the aperture could be slotted to accommodate front-to-rear variation. In this construction, the full length side channels 30 and the side braces 34 would not be utilized and the dishrack loading would be transferred from the cross braces to the shafts 68, to the wheels 66 and finally to the tub of the dishwasher.

The cross channels 28 and side channels 30 may be molded in a variety of shapes. In one embodiment shown in FIG. 1, the channels 28 and 30 are open on the bottom side thereof. In this open channel embodiment, the cross braces and side braces are preferably constructed of a rust-proof metal, such as stainless steel, since the braces are exposed to water during the operation of the dishwasher.

Figure 9A:
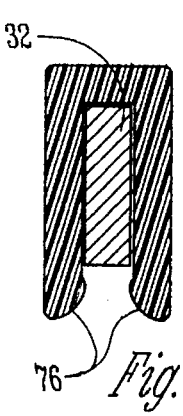
FIGS. 9A and 9B are sectional views showing a second embodiment of a channel in the base portion having closure members for sealing the channel.
Figure 9B:
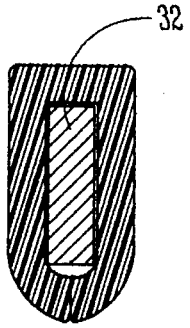

Three additional embodiments of the channels 28, 30 are shown in FIGS. 9A and 9B, 10A and 10B, and 11A and 11B. In the second embodiment shown in FIGS. 9A and 9B, the channel includes terminal ends 76 which can be heated or otherwise deformed so that the ends enclose the cross brace or side brace within the channel, as shown in FIG. 9B. The ends 76 can be welded to seal the channel against moisture. Accordingly, since the braces 32, 34 will not be exposed to water during operation of the dishwasher, the braces can be constructed of a strong yet inexpensive metal, such as carbon steel, which is less expensive than stainless steel.

Figure 10A:
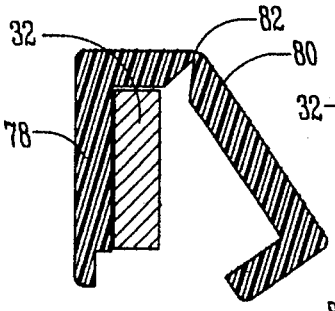
FIGS. 10A and 10B are sectional views showing a third embodiment of the channel in the base portion of the rack.
Figure 10B:
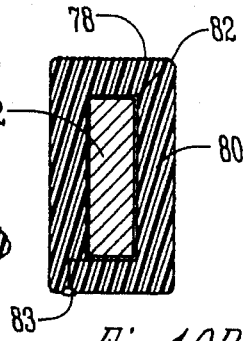

In the third embodiment shown in FIGS. 10A and 10B, the channel is formed by complimentarily shaped sections 78, 80. The channel sections 78, 80 are spaced apart when the rack is pulled from the mold. A natural hinge 82 formed by a reduced cross sectional area allows the channel section 80 to be pivoted into mating engagement with the channel section 78 after the brace has been inserted into the channel. Plastic welding 83 seals the mating ends of the sections to prevent access of moisture to the metal brace, such that the brace can be constructed of carbon steel rather than stainless steel.

Figure 11A:
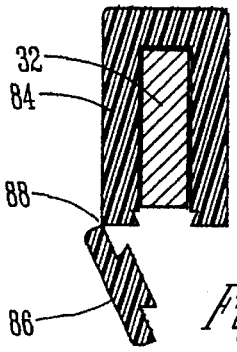
FIGS. 11A and 11B are sectional views showing a fourth embodiment of the channel in the base portion of the rack.
Figure 11B:
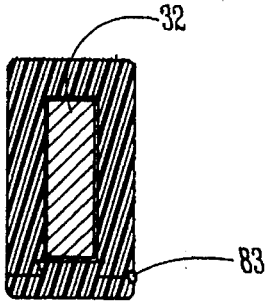
Figure 3:
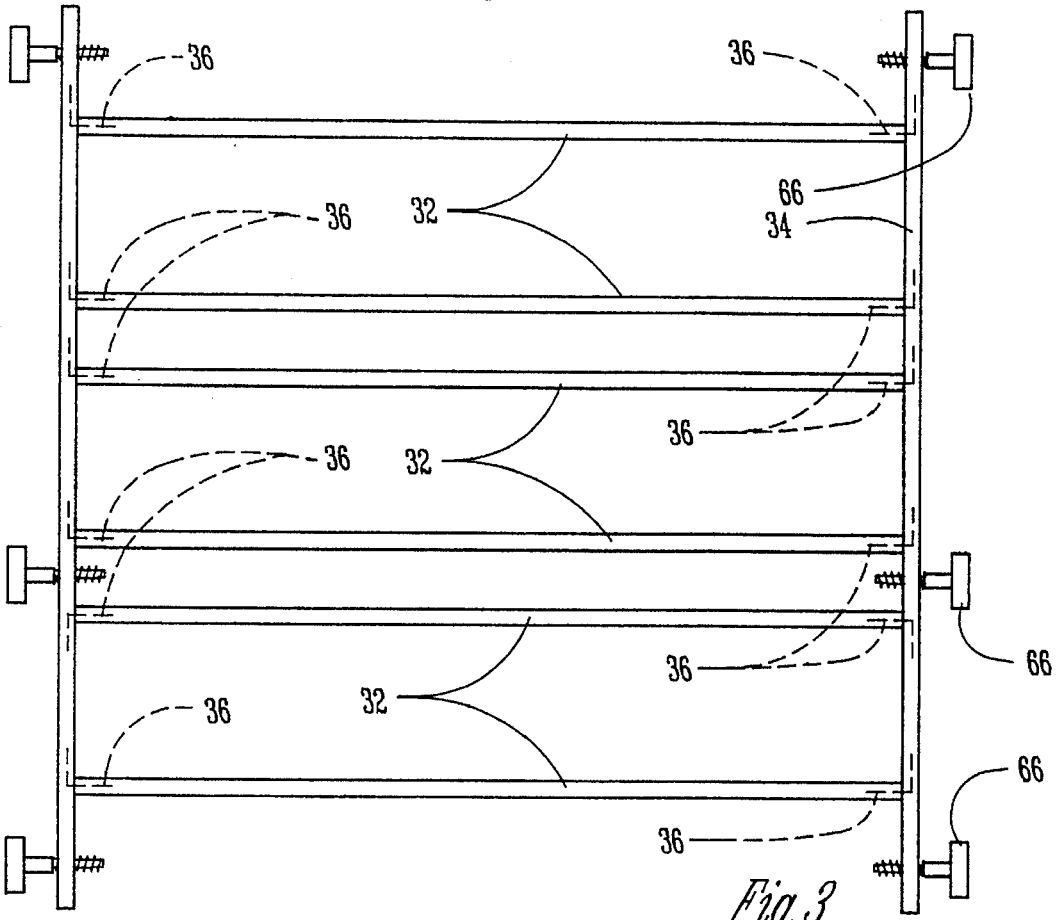
FIG. 3 is a plan view of the first embodiment of the metal grid.

In a fourth embodiment shown in FIGS. 11A and 11B, the channel includes a primary section 84 and a closure flap 86 which are formed during the molding process with a reduced cross sectional area which acts as a natural hinge 88. After the metal brace is inserted into the channel, the closure flap 86 can be pivoted from the open position shown in FIG. 11A to the closed position shown in FIG. 11B, and welded along weld seam 83 so as to seal the channel against moisture.

Figure 12:
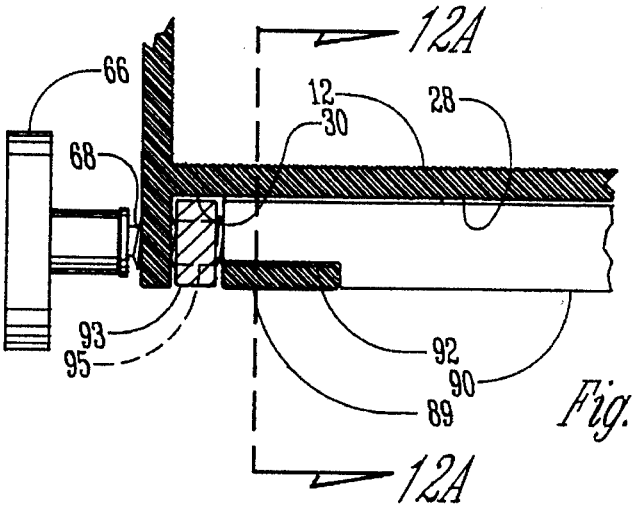
FIG. 12 is a partial sectional view showing a further embodiment of the channels in the base portion of the rack.
Figure 12A:
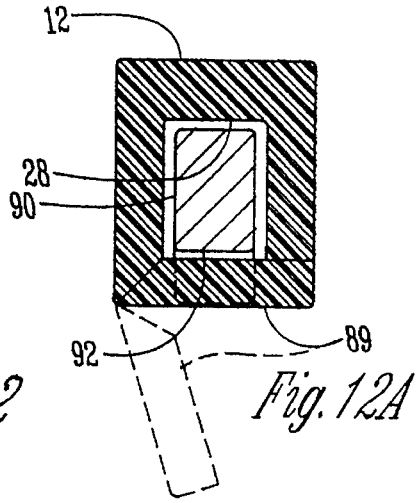
FIG. 12A is a sectional view taken along lines 12A—12A of FIG. 12.

A further embodiment of the rack 10 of the present invention is shown in FIG. 12. In the rack of FIG. 12, the cross channel 28 is formed with a pivotal brace retainer tab 89 which is movable between an open position, shown in dotted lines, and a closed position, shown in solid lines. After a cross brace 90 is inserted into the cross channel 28, the retainer tab 89 is pivoted from the open position to the closed position and locked in place by heating, or by other known methods, so as to retain the cross brace 90 within the channel 28. The cross brace 90 includes a notch 92 at each end, thereby providing a recessed area for receiving the retainer tab 89.

Figure 16:
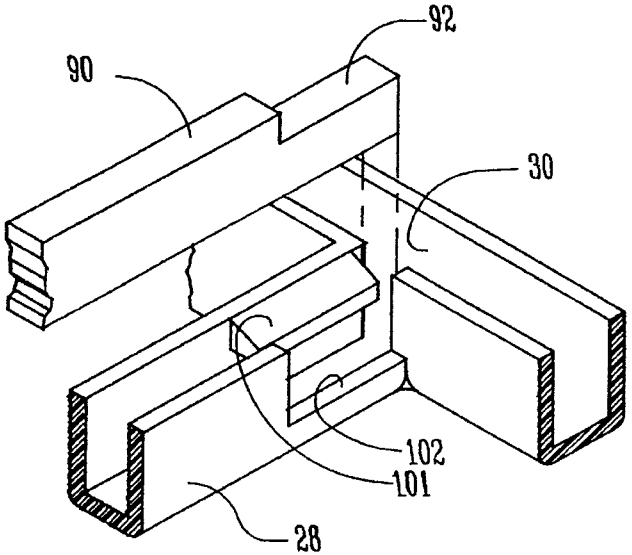
FIG. 16 is a pictorial view of a modified form of the present invention.

FIG. 16 shows a variation of the modification shown in FIG. 12. Instead of using a pivotal brace retainer tab 89, the cross channel 28 is formed with an integral snap tab 101 which would be molded into a side wall of the cross channel 28. A notch 102 is also molded into the other wall of cross channel 28. The notch portion 92 of cross brace 90 is retained by the integral snap tab instead of performing a secondary operation. Referring again to FIG. 12, the side brace 93 in the rack shown in FIG. 12 includes a slot 95 for receiving the shaft 68 of the wheel 66, such that the side brace 93 is retained within the side channel 30 by the wheel shaft 68.

Figure 13:
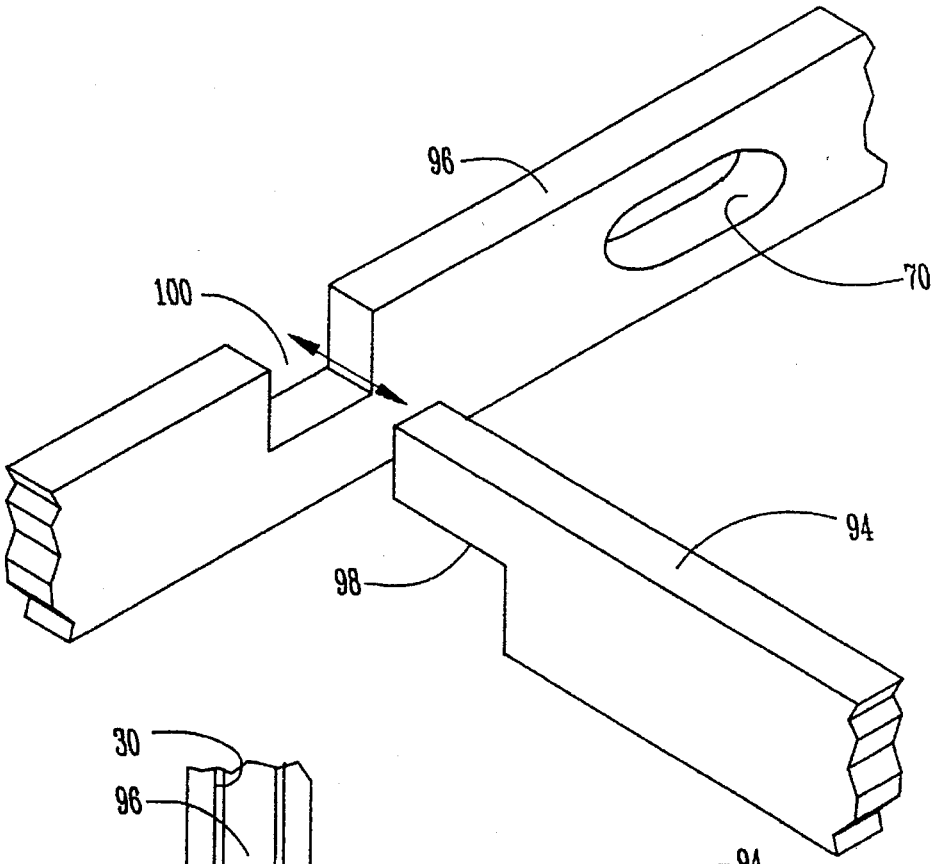
FIG. 13 is a partial sectional view showing a further embodiment of a sliding connection between a cross brace and a side brace.
Figure 14:
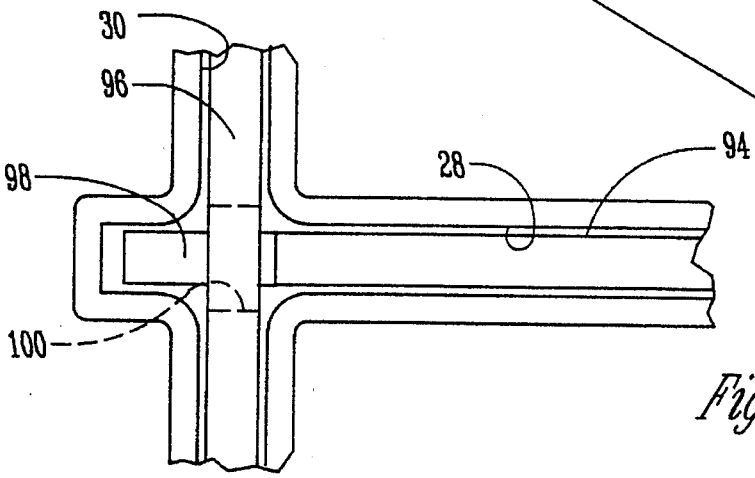
FIG. 14 is a partial plan view showing the cross brace and side brace of FIG. 13 inserted into a channel in the base portion of the rack.

Still another embodiment of the rack of the present invention is shown in FIGS. 13 and 14. In this embodiment, a cross brace 94 and a side brace 96 slidably receive one another without the use of a joiner or connector. More particularly, the cross brace 94 has an ear 98 on each end which is received within a slot 100 on the side brace 96. The length of the ear 98 is greater than the width of the side brace 96, and the length of the slot 100 is greater than the width of the ear 98, as best seen in FIG. 14. Therefore, the cross brace 94 and side brace 96 can be moved laterally and forwardly and rearwardly with respect to one another to accommodate variances in the molding process. The side brace 96 is secured within the side channel 30 by the wheel shaft 68 extending through the axially elongated slot 102.

In the embodiments shown in FIGS. 2–8 and FIGS. 13, 14, the load of the objects in the rack 10 are transferred to the tub of the dishwasher through the metal grid or lattice work formed by the cross braces 32 and side braces 34, which are interconnected by the connectors 36 (FIGS. 2–5), the tab 50 (FIG. 6), the tab 54 (FIG. 7), the T-collar (FIG. 8), or the ear 98 and slot 100 (FIGS. 13 and 14). In the embodiment shown in FIG. 12, the load from the objects in the rack is transferred to the tub via the braces 94, 96 and the plastic molded base portion 12. In each of these embodiments, the wheel 66 and wheel shaft 68 complete the load transfer by supporting the rack 10 on the tub of the dishwasher.

In constructing the rack of the present invention, in each of its embodiments, the plastic base portion 12 with walls 20, 22 and 24 is molded with the cross channels 28 and side channels 30 formed therein, including the channel closure means shown in FIGS. 9–11, if desired. In the metal grid work utilizing the embodiment shown in FIGS. 2–8, the cross braces 32 and side braces 34 are assembled into the grid or lattice work and then inserted into the channels of the base portion 12 after the rack has been removed from the mold. In the embodiments shown in FIGS. 12–14, the cross braces can be inserted into the cross channels 28 separately from the side braces being inserted into the side channels 30. The wheel shafts 68 are then inserted through the slot 70 in the side braces and threaded into the bosses 72 so as to support the metal grid, with the exception of the embodiment shown in FIG. 12 wherein the cross braces 90 are supported by the retainer tab 89.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A dishwasher rack for holding objects to be washed in a dishwasher having a tub, the rack comprising:

a plastic base portion with opposite upper and lower surfaces, opposite side edges, and opposite front and back edges;

plastic side walls extending upwardly from the opposite side edges of the base portion;

plastic front and back walls extending upwardly from the front and back edges of the base portion, respectively;

plurality of wheels extending from the side edges of the base portion and being adapted to engage the tub for movement of the rack relative no the tub;

the base portion having a plurality of cross channels formed therein and extending between the opposite side edges of the base portion; and a plurality of metal cross braces positioned within the cross channels to transfer the weight of the objects in the rack to the side edges of the rack, and thus to the wheels and to the tub.

2. The rack support structure of claim 1 wherein the rack base portion has opposite side channels formed therein adjacent the respective side edges and extending toward the front and back edges, and opposite side braces being positioned within the side channels.

3. The rack support structure of claim 2 wherein each of the cross braces has opposite ends which are structurally joined to the side braces.

4. The rack support structure of claim 2 wherein the cross braces and side braces are slidably joined to accommodate tolerances in the channels of the rack base portion.

5. The rack support structure of claim 2 further comprising a plurality of connectors for interconnecting the cross braces and side braces.

6. The rack support structure of claim 5 wherein the connectors slidably interconnect the cross braces and side braces to accommodate tolerance in the channels of the rack base portion.

7. The rack support structure of claim 5 wherein each of the connectors is L-shaped with substantially perpendicular first and second legs, the first leg being adapted to engage the cross brace and the second leg being adapted to engage the side brace.

8. The rack support structure of claim 7 wherein each of the cross braces and side braces is C-shaped with a groove for slidably receiving one of the legs of the connector.

9. The rack support structure system of claim 7 wherein the side brace has a slot through which the first leg of the connector extends.

10. The rack support structure of claim 5 wherein each of the connectors is a T-shaped collar having a leg for slidably receiving one end of the cross brace and a hollow head for slidably receiving the side brace.

11. The rack support structure of claim 2 wherein the side brace has a slot and the cross brace has a tab extendible through the slot.

12. The rack support structure of claim 11 wherein the tab extends longitudinally from an end of the cross brace.

13. The rack support structure of claim 11 wherein the tab extends substantially perpendicularly from an end of the cross brace.

14. The rack support structure of claim 11 wherein the slot has a width greater than the width of the tab and the tab has a length greater than the width of the side brace to accommodate tolerances in the channels of the rack base portion.

15. The rack support system of claim 1 wherein the rack base portion includes a hinged member for each cross channel to close the cross channel after the cross brace has been inserted.

16. The rack support structure of claim 15 wherein the hinged member is sealed over the cross channel to lock out moisture.

17. The rack support structure of claim 1 wherein the rack base portion includes a brace retainer for each end of each cross brace for retentively holding the cross brace in position within the cross channel.

18. The rack support structure of claim 17 wherein the brace retainer is movable between open and closed positions.

19. A method of constructing support structure for a molded plastic dishwasher rack, comprising:

molding a rack base portion with opposite side edges and opposite front and back edges, and having a plurality of cross channels formed therein and extending between opposite side edges of the base portion; and inserting a metal cross brace in each cross channel.

20. The method of claim 19 further comprising molding a plurality of side channels in the rack base portion adjacent each side edge and extending toward the front and rear edges, and inserting a side brace in each side channel.

21. The method of claim 20 further comprising connecting the cross braces to each side brace.

22. The method of claim 20 further comprising slidably connecting the cross braces to each side brace to accommodate tolerances in the rack base portion.

23. The method of claim 20 further comprising assembling the cross braces and side braces into a grid and then inserting the grid into the cross channels and side channels.

24. The method of claim 19 further comprising sealing the cross channels to exclude moisture from the channels.

25. Support structure for a molded plastic dishwasher rack enabling the rack to support the weight of objects placed therein, comprising:

a rack base portion including opposite side edges and opposite front and back edges, the rack base portion having a plurality of cross channels formed therein and extending between the opposite side edges thereof;

a plurality of wheels attached to and extending from the side edges of the rack base portion and engageable with a support surface for movement of the rack relative thereto; and a plurality of metal cross braces positioned within the cross channels to transfer the weight of the objects in the rack to the opposite side edges of the rack, and thus to the wheels and to the support surface.

26. Support structure for a molded plastic dishwasher rack enabling the rack to support the weight of objects placed therein, comprising:

a rack base portion including opposite side edges and opposite front and back edges, the rack base portion having a plurality of channels formed therein and extending between either the opposite side edges or the opposite front and back edges; and a plurality of metal braces positioned within at least a portion of said channels to transfer the weight of the objects in the rack to the edges thereof.

* * * * *